US007413842B2

(12) United States Patent
Vanbesien et al.

(10) Patent No.: US 7,413,842 B2
(45) Date of Patent: Aug. 19, 2008

(54) TONER PROCESSES

(75) Inventors: Daryl Vanbesien, Burlington (CA); David J. Sanders, Oakville (CA); Raj D. Patel, Oakville (CA); Christine D. Anderson, Hamilton (CA); Patricia Ann Burns, Milton (CA); Nam-Suk Ro, Mississauga (CA)

(73) Assignee: Xerox Corporation, Norwalk, CT (US)

( * ) Notice: Subject to any disclaimer, the term of this patent is extended or adjusted under 35 U.S.C. 154(b) by 424 days.

(21) Appl. No.: 11/208,907

(22) Filed: Aug. 22, 2005

(65) Prior Publication Data

US 2007/0042286 A1 Feb. 22, 2007

(51) Int. Cl.
*G03G 9/08* (2006.01)

(52) U.S. Cl. ..... 430/137.14; 430/108.8; 430/120.1

(58) Field of Classification Search ..... 430/137.14, 430/108.8, 120, 120.1
See application file for complete search history.

(56) References Cited

U.S. PATENT DOCUMENTS

| | | | | |
|---|---|---|---|---|
| 3,590,000 | A | 6/1971 | Palermiti et al. | 430/108.3 |
| 3,655,374 | A | 4/1972 | Palermiti et al. | 430/121 |
| 3,674,736 | A | 7/1972 | Lerman et al. | 523/307 |
| 3,720,617 | A | 3/1973 | Chatterji et al. | 430/108.3 |
| 3,944,493 | A | 3/1976 | Jadwin et al. | 430/108.21 |
| 3,983,045 | A | 9/1976 | Jugle | 430/108.1 |
| 4,007,293 | A | 2/1977 | Mincer | 430/111.1 |
| 4,079,014 | A | 3/1978 | Burness | 430/108.21 |
| 4,265,660 | A | 5/1981 | Giflo | 420/83 |
| 4,394,430 | A | 7/1983 | Jadwin | 430/108.2 |
| 4,560,635 | A | 12/1985 | Hoffend et al. | 430/108.2 |
| 4,935,326 | A | 6/1990 | Creatura | 430/111.32 |
| 4,937,166 | A | 6/1990 | Creatura | 430/111.32 |
| 5,278,020 | A | 1/1994 | Grushkin | 430/109.3 |
| 5,290,654 | A | 3/1994 | Sacripante | 430/137.14 |
| 5,308,734 | A | 5/1994 | Sacripante | 430/137.14 |
| 5,344,738 | A | 9/1994 | Kmiecik-Lawrynowicz | 430/137.14 |
| 5,346,797 | A | 9/1994 | Kmiecik-Lawrynowicz | 430/137.14 |
| 5,348,832 | A | 9/1994 | Sacripante | 430/109.4 |
| 5,364,729 | A | 11/1994 | Kmiecik-Lawrynowicz | 430/137.14 |
| 5,366,841 | A | 11/1994 | Patel | 430/137.14 |
| 5,370,963 | A | 12/1994 | Patel | 430/137.14 |
| 5,403,693 | A | 4/1995 | Patel | 430/137.14 |
| 5,405,728 | A | 4/1995 | Hopper | 430/137.14 |
| 5,418,108 | A | 5/1995 | Kmiecik-Lawrynowicz | 430/137.14 |
| 5,482,812 | A | 1/1996 | Hopper et al. | 430/137.14 |
| 5,496,676 | A | 3/1996 | Croucher | 430/137.14 |
| 5,501,935 | A | 3/1996 | Patel | 430/137.14 |
| 5,527,658 | A | 6/1996 | Hopper | 430/137.14 |
| 5,585,215 | A | 12/1996 | Ong | 430/108.2 |
| 5,622,806 | A | 4/1997 | Veregin | 430/137.11 |
| 5,650,255 | A | 7/1997 | Ng | 430/137.14 |
| 5,650,256 | A | 7/1997 | Veregin | 430/137.14 |
| 5,723,253 | A | 3/1998 | Higashino | 430/166 |
| 5,744,520 | A | 4/1998 | Kmiecik-Lawrynowicz | 523/334 |
| 5,747,215 | A | 5/1998 | Ong et al. | 430/137.14 |
| 5,763,133 | A | 6/1998 | Ong et al. | 430/137.14 |
| 5,766,818 | A | 6/1998 | Smith et al. | 430/137.17 |
| 5,804,349 | A | 9/1998 | Ong et al. | 430/109.31 |
| 5,827,633 | A | 10/1998 | Ong et al. | 430/137.14 |
| 5,840,462 | A | 11/1998 | Foucher et al. | 430/137.14 |
| 5,853,944 | A | 12/1998 | Foucher et al. | 430/137.14 |
| 5,863,698 | A | 1/1999 | Patel et al. | 430/137.14 |
| 5,869,215 | A | 2/1999 | Ong et al. | 430/137.14 |
| 5,902,710 | A | 5/1999 | Ong et al. | 430/108.1 |
| 5,910,387 | A | 6/1999 | Mychajlowskij et al. | 430/109.31 |
| 5,916,725 | A | 6/1999 | Patel et al. | 430/137.14 |
| 5,919,595 | A | 7/1999 | Mychajlowskij et al. | 430/137.14 |
| 5,922,501 | A | 7/1999 | Cheng et al. | 430/137.14 |
| 5,925,488 | A | 7/1999 | Patel et al. | 430/137.14 |
| 5,945,245 | A | 8/1999 | Mychajlowskij et al. | 430/137.14 |
| 5,977,210 | A | 11/1999 | Patel et al. | 523/161 |
| 5,994,020 | A | 11/1999 | Patel et al. | 430/137.14 |
| 6,020,101 | A | 2/2000 | Sacripante et al. | 430/110.2 |
| 6,120,967 | A | 9/2000 | Hopper et al. | 430/137.14 |
| 6,130,021 | A | 10/2000 | Patel et al. | 430/137.14 |
| 6,132,924 | A | 10/2000 | Patel et al. | 430/137.14 |
| 6,294,306 | B1 | 9/2001 | Kmiecik-Lawrynowicz et al. | 430/137.14 |
| 6,447,974 | B1 | 9/2002 | Chen et al. | 430/137.14 |
| 6,576,389 | B2 | 6/2003 | Vanbesien | 430/137.14 |
| 6,617,092 | B1 | 9/2003 | Patel et al. | 430/137.14 |
| 6,638,677 | B2 | 10/2003 | Patel et al. | 430/137.14 |
| 6,664,017 | B1 | 12/2003 | Patel et al. | 430/120 |
| 6,673,505 | B2 | 1/2004 | Jiang | 430/137.14 |
| 6,780,560 | B2 | 8/2004 | Farrugia et al. | 430/137.14 |
| 2005/0255402 | A1 * | 11/2005 | Hopper et al. | 430/137.14 |
| 2006/0172220 | A1 * | 8/2006 | Patel et al. | 430/137.14 |

* cited by examiner

*Primary Examiner*—John L Goodrow
(74) *Attorney, Agent, or Firm*—Marylou J. Lavoie, Esq. LLC

(57) ABSTRACT

A toner process comprising aggregating or coagulating a latex emulsion comprising a resin, a colorant and wax particles using an amount of polymetal ion coagulant to provide core particles; heating the core particles to provide micron size aggregates; optionally adding a second resin emulsion; adding a sequestering or complexing component and a base to remove the polymetal ion in a controlled manner; further heating the mixture to provide toner particles; and optionally, isolating the toner particles.

26 Claims, No Drawings

TONER PROCESSES

BACKGROUND

The present disclosure is generally related to toner processes, and more specifically, to aggregation and coalescence processes for the preparation of toner compositions wherein a complexing or sequestering agent is added during the aggregation process.

Provided are toner processes for the economical chemical in situ preparation of toners without the utilization of the known pulverization and/or classification methods, and wherein in embodiments toner compositions with a volume average diameter of about 1 to about 25 and more specifically about 1 to about 10 microns, and a narrow geometric size distribution (GSD) of, for example, about 1.14 to about 1.25 as measured on the Coulter Counter, can be obtained. The resulting toners can be selected for known electrophotographic imaging, digital, printing processes, including color processes, and lithography.

In reprographic technologies, such as xerographic and ionographic devices, toners with volume average diameter particle sizes of form about 9 microns to about 20 microns are effectively utilized. Moreover, in xerographic technologies, such as the high volume Xerox Corporation 5090 copier duplicator, high resolution characteristics and low image noise are highly desired, and can be attained utilizing the small sized toners as disclosed herein having, for example, a volume average particle diameter of from about 2 to about 11 microns, or less than about 7 microns, and with a narrow geometric size distribution (GSD) of from about 1.14 to about 1.25 or about 1.16 to about 1.20. Additionally, in xerographic systems wherein process color is utilized, such as pictorial color applications, small particle size colored toners, for example from about 3 to about 9 microns, are desired to avoid paper curling. Also, small toner particle sizes can be selected, such as from about 1 to about 7 microns, and with higher colorant loading, such as from about 5 to about 12 percent by weight of toner, such that the mass of toner layers deposited onto the substrate such as paper is reduced to obtain the same quality of image and resulting in a thinner plastic toner layer on paper after fusing, thereby minimizing or avoiding paper curling.

Toners prepared in accordance with the present disclosure provide desired fusing characteristics including, for example, desired release characteristics such as stripping force, for example of less than about 30 grams of force to less than about 5 grams of force, desired blocking characteristics such as for example, a high blocking temperature of about 45° C. to about 65° C., desired document offset characteristics, such as a document offset of about 2.0 to about 5.0 desired vinyl offset characteristics, such as a vinyl offset of about 3.0 to about 5.0 and desired triboelectrical charging characteristics. Further, toners prepared in accordance with the present disclosure enable in embodiments, the use of lower minimum imaging fusing temperatures, such as from about 120° C. to about 170° C., enable high speed printing such as for machines running at greater than about 35 pages per minute. Further, the present toner processes and toners enable high image gloss, such as in an oil-less fuser system while still retaining a high blocking temperature, high image gloss comprising for example from about 30 to about 60 gloss units (GGU) as measured by the Gardner Gloss metering unit, a high image gloss of greater than about 30 GGU, greater than about 40 GGU, or greater than about 50 GGU, for example on a coated paper, such as Xerox 120 gsm Digital Coated Gloss papers.

Numerous processes are known for the preparation of toners, such as, for example, conventional polyester processes wherein a resin is melt kneaded or extruded with a pigment, micronized and pulverized to provide toner particles with a volume average particle diameter of from about 9 microns to about 20 microns and with broad geometric size distribution of from about 1.26 to about 1.5. In these processes, it is usually necessary to subject the aforementioned toners to a classification procedure such that the geometric size distribution of from about 1.2 to about 1.4 is attained. Also, in the aforementioned conventional processes, low toner yields after classifications may be obtained. Generally, during the preparation of toners with average particle size diameters of from about 11 microns to about 15 microns, toner yields range from about 70 percent to about 85 percent after classification. Additionally, during the preparation of smaller sized toners with particle sizes of from abut 7 microns to about 11 microns, lower toner yields can be obtained after classification, such as from about 50 percent to about 70 percent. With the present processes, small average particle sizes of, for example, from about 3 microns to about 9 microns, and more specifically, about 4 to about 6 microns or about 5 microns, are attained without resorting to classification processes, and wherein narrow geometric size distributions are attained, such as from about 1.14 to about 1.30, or from about 1.14 to about 1.25. High toner yields are also attained such as from about 90 percent to about 98 percent. In addition, by the present toner processes, small particle size toners of from about 3 microns to about 7 microns can be economically prepared in high yields such as from about 90 percent to about 98 percent by weight based on the weight of all of the toner ingredients, such as toner resin and colorant.

In U.S. Pat. No. 6,132,924, the disclosure of which is totally incorporated herein by reference, there is illustrated a process for the preparation of toner comprising mixing a colorant a latex, and a coagulant, followed by aggregation and coalescence, wherein the coagulant may be a polyaluminum chloride.

In U.S. Pat. No. 6,268,102, the disclosure of which is totally incorporated herein by reference, there is illustrated a process for the preparation of toner comprising mixing a colorant, a latex, and a coagulant, followed by aggregation and coalescence, wherein the coagulant may be a polyaluminum sulfosilicate.

Illustrated in U.S. Pat. No. 5,994,020, the disclosure of which is totally incorporated herein by reference, are toner preparation processes, and more specifically, a process for the preparation of toner comprising: (i) preparing, or providing a colorant dispersion; (ii) preparing, or providing a functionalized wax dispersion comprised of a functionalized wax contained in a dispersant mixture comprised of a nonionic surfactant, an ionic surfactant, or mixtures thereof; (iii) shearing the resulting mixture of the functionalized wax dispersion (ii) and the colorant dispersion (i) with a latex or emulsion blend comprised of resin contained in a mixture of an anionic surfactant and a nonionic surfactant; (iv) heating the resulting sheared blend of (iii) below about the glass transition temperature (Tg) of the resin particles; (v) optionally adding additional anionic surfactant to the resulting aggregated suspension of (iv) to prevent, or minimize additional particle growth of the resulting electrostatically bound toner size aggregates during coalescence (iv);heating the resulting mixture of (v) above about the Tg of the resin; and optionally, (vii) separating the toner particles.

With respect to the references, only a small part thereof has been selected and this part may or may not be fully representative of the prior art teachings or disclosures.

Emulsion/aggregation/coalescence processes for the preparation of toners are illustrated in a number of Xerox patents, the disclosures of each of which are totally incorporated herein by reference, such as U.S. Pat. No. 5,290,654, U.S. Pat. No. 5,278,020, U.S. Pat. No. 5,308,734, U.S. Pat. No. 5,370,963, U.S. Pat. No. 5,344,738, U.S. Pat. No. 5,403,693, U.S. Pat. No. 5,418,108, U.S. Pat. No. 5,364,729, and U.S. Pat. No. 5,346,797; and also of interest may be U.S. Pat. Nos. 5,348,832; 5,405,728; 5,366,841; 5,496,676; 5,527,658; 5,585,215; 5,650,255; 5,650,256; 5,501,935; 5,723,253; 5,744,520; 5,763,133; 5,766,818; 5,747,215; 5,827,633; 5,853,944; 5,804,349; 5,840,462; 5,869,215; 5,863,698; 5,902,710; 5,910,387; 5,916,725; 5,919,595; 5,925,488; 5,977,210; 5,994,020; 6,020,101; 6,130,021; 6,120,967 and 6,628,102.

In addition, the following U.S. patents relate to emulsion aggregation processes of forming toner compositions, the disclosures of each of which are totally incorporated herein by reference.

U.S. Pat. No. 5,922,501 describes a process for the preparation of toner comprising blending an aqueous colorant dispersion and a latex resin emulsion, and which latex resin is generated from a dimeric acrylic acid, an oligomer acrylic acid, or mixtures thereof and a monomer; heating the resulting mixture at a temperature about equal, or below about the glass transition temperature (Tg) of the latex resin to form aggregates; heating the resulting aggregates at a temperature about equal to, or above about the Tg of the latex resin to effect coalescence and fusing of the aggregates; and optionally isolating the toner product, washing, and drying.

U.S. Pat. No. 5,945,245 describes a surfactant free process for the preparation of toner comprising heating a mixture of an emulsion latex, a colorant, and an organic complexing agent.

U.S. Pat. No. 5,482,812 describes a process for the preparation of toner compositions or toner particles comprising (i) providing an aqueous pigment dispersion comprised of a pigment, an ionic surfactant, and optionally a charge control agent; (ii) providing a wax dispersion comprised of, wax, a dispersant comprised of nonionic surfactant, ionic surfactant or mixtures thereof; (iii) shearing a mixture of the wax dispersion and the pigment dispersion with a latex or emulsion blend comprised of resin, a counterionic surfactant with a charge polarity of opposite sign to that of said ionic surfactant, and a nonionic surfactant; (iv) heating the above sheared blend below about the glass transition temperature (Tg) of the resin to form electrostatically bound toner size aggregates with a narrow particle size distribution; (v) adding additional ionic surfactant to the aggregated suspension of (iv) to ensure that no, or minimal additional particle growth of the electrostatically bound toner size aggregates occurs on further increasing the temperature to coalesce the aggregates into toner particles (vi); (vi) heating the mixture of (v) with bound aggregates above about or at the Tg of the resin; and optionally (vii) separating the toner particles from the aqueous slurry by filtration and thereafter optionally washing.

U.S. Pat. No. 5,622,806 describes a process, for example, for the preparation of toner compositions with controlled particle size comprising (i) preparing a pigment dispersion in water, which dispersion is comprised of a pigment, an ionic surfactant in amounts of from about 0.5 to about 10 percent by weight to water, and an optional charge control agent; (ii) shearing the pigment dispersion with a latex mixture comprised of a counterionic surfactant with a charge polarity of opposite sign to that of the ionic surfactant, a nonionic surfactant, and resin particles, thereby causing a flocculation or heterocoagulation of the formed particles of pigment, resin, and charge control agent; and (iii) stirring.

The appropriate components and process aspects of the each of the foregoing U.S. Patents may be selected for the present disclosure in embodiments thereof

SUMMARY

Aspects illustrated herein include a toner process comprising aggregating a latex emulsion comprising a resin, a colorant and a wax using an amount of metal ion coagulant to provide particles; heating the particles to provide micron size aggregates; optionally adding a second resin emulsion; adding a sequestering component and a base to remove the metal ion in a controlled manner; further heating the mixture to provide toner particles; and optionally, isolating the toner particles.

Further aspects illustrated herein include a toner process comprising (i) generating or providing a latex emulsion containing resin, water, and a surfactant, and generating or providing a colorant dispersion containing colorant, water, and an ionic surfactant, or a nonionic surfactant; (ii) blending the latex emulsion with the colorant dispersion and wax; (iii) adding to the resulting blend a coagulant comprising a polymetal ion coagulant, a metal ion coagulant, a polymetal halide coagulant, a metal halide coagulant or a mixture thereof; (iv) aggregating by heating the resulting mixture below or about equal to the glass transition temperature (Tg) of the latex resin; (v) optionally adding a second latex comprised of resin particles suspended in an aqueous phase resulting in a shell; (vi) introducing a sequestering to partially remove coagulant metal from the aggregated toner in a controlled manner; (vii) heating the resulting mixture of (vi) above about the Tg of the latex resin at a pH of about 5 to about 6; (viii) retaining the heating until the fusion or coalescence of resin and colorant is initiated; (ix) changing the pH of the above (viii) mixture to arrive at a pH from about 6.0 to about 7.5 to thereby accelerate the fusion or the coalescence and resulting in toner particles comprised of resin, colorant, and having a final coagulant metal concentration of about 100 to about 900 parts per million based on the total weight of the toner particle; and (x) optionally, isolating the toner.

DESCRIPTION

Toner processes are provided including, for example, aggregation and coalescence toner processes for the preparation of toner compositions wherein a complexing component or sequestering component is added during the aggregation process. More specifically, the present disclosure is directed to toner processes and toner compositions wherein a complexing or sequestering component which can be, for example, an organic complexing component or an inorganic complexing component, is added during aggregation to partially remove some of the coagulant metal from the toner aggregates in a controlled manner to achieve a final metal content in the dry toner of up to about 900 parts per million, about 100 to about 900 parts per million, or about 150 to about 500 parts per million.

Toner processes herein include use of a metal ion coagulant or a polymetal ion coagulant selected, for example, from a polymetal halide, a metal halide or mixtures thereof. Polymetal ion coagulants that can be selected, include, but are not limited to, for example, polyaluminum chloride (PAC), polyaluminum sulfosilicate, chlorides, sulfates, and phosphates of sodium, calcium, aluminum, magnesium, zinc, potassium, and zirconium. More specifically, for example, the metal ion coagulant can be selected from the group consisting of sodium chlorides, calcium chlorides, aluminum chlorides, magnesium chlorides, zinc chlorides, potassium chlorides, zirconium chlorides, sodium sulfates, calcium sulfates, aluminum sulfates, magnesium sulfates, zinc sulfates, potassium sulfates, zirconium sulfates, sodium phosphates, calcium phosphates, aluminum phosphates, magnesium phosphates, zinc phosphates, potassium phosphates, zirconium phosphates, and mixtures thereof.

The amount of sequestering agent can be selected based upon the particular sequestering agent used (i.e. its Molecular Weight) and the type of coagulant, for example, polyaluminum chloride or other. For example, the process can include introducing the sequestering or complexing component in an amount selected from about 0.02 weight percent to about 4.0 weight percent based upon the total weight of solids. The amount of polymetal ion coagulant selected to achieve a desired final residual coagulant metal concentration can be calculated from the following equation:

$$M_{Seq}=M_{IMC}-M_{RM} \quad (1)$$

wherein $M_{Seq}$ represents the required moles of sequestering agent, $M_{IMC}$ represents the initial moles of metal in the coagulant, and $M_{RM}$ represents the desired final coagulant metal concentration in moles.

The process further provides optionally changing the pH of the mixture with a base to arrive at a pH of above about 6.0 to about 7.5 to thereby stop the fusion or the coalescence results of the toner particles. Heating the resulting mixture, for example the mixture of (vii), above about the Tg of the latex resin at a pH of about 5 to about 6 results in an acid component of the resin, for example a carboxylic acid component, becoming ionized providing additional negative charge on the aggregates thereby providing stability such that no further or minimal aggregation or particle size growth is observed when heating above the Tg of the latex resin.

In further aspects toner processes are provided resulting in a toner particle comprised of a first resin, a second resin, wax, and a colorant present, for example, in a ratio of about 25% to about 99% first resin, about 0% to about 35% second resin about 1% to about 30% wax, and about 1% to about 15% colorant, by weight based upon the total weight of the first resin, second resin, wax and colorant, or about 50% to about 65% first resin, about 20% to about 35% second resin about 5% to about 15% wax, and about 3% to about 10% colorant, by weight based upon the total weight of the first resin, second resin, wax and colorant; toner processes resulting in a toner particle possessing a shape factor of about 100 to about 160, a circularity of about 0.920 to about 0.999, or a combination thereof The size of the toner particles can be, for example, from about 1 to about 25 microns, from about 3 microns to about 9 microns, more specifically, from about 4 microns to about 6 microns or about 5 microns.

The colorant dispersion can be selected for example as a pigment dispersion comprising pigment particles having a volume average diameter of about 50 to about 500 nanometers, water, an anionic surfactant, and optionally a polymeric stabilizer.

Further, the latex emulsion resin and optionally the second optional resin can be selected to contain a carboxylic acid group selected from the group consisting of acrylic acid, methacrylic acid, itaconic acid, beta-carboxyethyl acrylate, fumaric acid, maleic acid, and cinnamic acid; and wherein a carboxylic acid is selected in an amount of about 0.1% to about 10%, by weight based upon the total weight of the resin.

Further, in embodiments comprising generating or providing a latex emulsion containing resin, water, and a surfactant, and generating or providing a colorant dispersion containing colorant, water, and an ionic surfactant, or a nonionic surfactant, wherein the ionic surfactant can be an anionic surfactant selected for example in an amount of about 0.1% to about 10% by weight based upon a total weight of the reaction mixture. The anionic surfactant can be selected, for example, from the group consisting of sodium dodecylsulfate, sodium dodecylbenzene sulfonate, sodium dodecylnaphthalene sulfate, dialkyl benzenealkyl, sulfates, sulfonates, adipic acid, hexa decyldiphenyloxide disulfonate, or mixtures thereof.

The resin particles selected, which generally can be, in embodiments, styrene acrylates, styrene butadienes, styrene methacrylates, or polyesters, are present in various effective amounts, such as from about 70 weight percent to about 98 weight percent, and more specifically, about 80 weight percent to about 92 weight percent based upon the total weight percent of the toner. The resin can be of small average particle size, such as from about 0.01 micron to about 1 micron in average volume diameter as measured by the Brookhaven nanosize particle analyzer. Other effective amounts of resin can be selected.

In embodiments, the resin selected can be a non cross linked resin such as, for example, a non cross linked resin comprising styrene:butylacrylate:beta-carboxyethyl acrylate although not limited to these monomers, wherein, for example, the non cross linked resin monomers are present in an amount of about 40% to about 95% styrene, about 5% to about 60% butylacrylate, and about 0.05 parts per hundred to about 10 parts per hundred beta-carboxyethyl acrylate; or about 60% to about 85% styrene, about 15% to about 40% butylacrylate, and about 1 part per hundred to about 5 parts per hundred beta-carboxyethyl acrylate, by weight based upon the total weight of the monomers, although not limited.

For example, the resin may be selected to contain a carboxylic acid group selected, for example, from the group comprised of, but not limited to, acrylic acid, methacrylic acid, itaconic acid, beta carboxy ethyl acrylate (beta CEA), fumaric acid, maleic acid, and cinnamic acid, and wherein, for example, a carboxylic acid is selected in an amount of form about 0.1 to about 10 weight percent of the total weight of the resin.

As used herein, a non cross linked resin is a resin that is substantially free of cross linking, for example, a resin having substantially about zero percent cross linking to about 0.2 percent cross linking or a resin having less than about 0.1 percent cross linking; and a cross linked resin refers for example, to a cross linked resin or gel comprising, for example, about 0.3 to about 20 percent cross linking.

In embodiments, the second latex can be a high glass transition temperature (high Tg) resin comprising about 40% to about 95% styrene, about 5% to about 60% butylacrylate, and about 0.05 parts per hundred to about 10 parts per hundred beta-carboxyethyl acrylate; or about 65% to about 90% styrene, about 10 to about 35% butyl acrylate, and about 1 part per hundred to about 5 parts per hundred beta-carboxyethyl acrylate, by weight based upon the total weight of the monomers, although not limited.

In further embodiments, the process provides a first resin (resin A) comprising a non cross linked resin having a first Tg of about 46° C. to about 56° C., about 48° C. to about 54° C., or about 51° C., and a second non cross linked resin (resin B) having a high Tg (high Tg being for example a glass transition temperature that is about 5° C. to about 10° C. higher than the Tg of the first resin) of for example, at Tg of about 54° C. to about 65° C., about 56° C. to about 64° C., or about 59° C.

Illustrative examples of latex polymer or resin particles include known polymers selected from the group consisting of styrene acrylates, styrene methacrylates, butadienes, isoprene, acrylonitrile, acrylic acid, methacrylic acid, beta-carboxy ethyl acrylate, polyesters, poly(styrene-butadiene), poly(methyl styrene-butadiene), poly(methyl methacrylate-butadiene), poly(ethyl methacrylate-butadiene), poly(propyl methacrylate-butadiene), poly(butyl methacrylate-butadiene), poly(methyl acrylate-butadiene), poly(ethyl acrylate-butadiene), poly(propyl acrylate-butadiene), poly(butyl acrylate-butadiene), poly(styrene-isoprene), poly(methyl styrene-isoprene), poly(methyl methacrylate-isoprene), poly (ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), poly(butyl acrylate-isoprene); poly(styrene-propyl acrylate), poly(styrene-butyl acrylate), poly(styrene-butadiene-acrylic acid), poly(styrene-butadiene-methacrylic acid), poly(styrene-butyl acrylate-acrylic acid), poly (styrene-butyl acrylate-methacrylic acid), poly(styrene-butyl acrylate-acrylonitrile), poly(styrene-butyl acrylate-acrylonitrile-acrylic acid), and styrene/butyl acrylate/carboxylic acid terpolymers, styrene/butyl acrylate/beta-carboxy ethyl acrylate terpolymers, PLIOTONE™ available from Goodyear, and mixtures thereof The latex emulsion resin and the optional second latex resin selected can comprise the same resin or different resins.

The resin particles selected can be prepared by, for example, emulsion polymerization techniques, including semicontinuous emulsion polymerization methods, and the monomers utilized in such processes can be selected from, for example, styrene, acrylates, methacrylates, butadiene, isoprene, and optionally acid or basic olefinic monomers, such as acrylic acid, methacrylic acid, acrylamide, methacrylamide, quaternary ammonium halide of dialkyl or trialkyl acrylamides or methacrylamide, vinylpyridine, vinylpyrrolidone, vinyl-N-methylpyridinium chloride, and the like. The presence of acid or basic groups in the monomer or polymer resin is optional, and such groups can be present in various amounts of from about 0.1 to about 10 percent by weight of the polymer resin. Chain transfer agents, such as dodecanethiol or carbon tetrabromide, can also be selected when preparing resin particles by emulsion polymerization. Other processes of obtaining resin particles of from about 0.01 micron to about 1 micron can be selected from polymer microsuspension process, such as illustrated in U.S. Pat. No. 3,674,736, the disclosure of which is totally incorporated herein by reference, polymer solution microsuspension process, such as disclosed in U.S. Pat. No. 5,290,654, the disclosure of which is totally incorporated herein by reference, mechanical grinding process, or other known processes.

In embodiments, the toners processes disclosed herein comprise preparing a non cross linked latex resin (resin A) comprising, for example, styrene:butylacrylate:beta-carboxyethyl acrylate (monomers A, B, and C), by an emulsion polymerization, in the presence of an initiator, a chain transfer agent, and surfactant. The amount and composition of the resin monomers comprise, for example, about 70% to about 90% styrene, about 10% to about 30% butyl acrylate, and bout 0.5 to about 10 parts per hundred beta-carboxyethyl acrylate, or about 76.5% styrene, 23.5% butyl acrylate, and 3 parts per hundred beta-carboxyethyl acrylate, although not limited to the particular range or type. The amounts of initiator, such as for example, sodium persulfate, potassium persulfate, or ammonium persulfate, can be selected in the range of about 0.5 to about 5.0 percent by weight of the monomers, although not limited. The amount of chain transfer agent utilized can be selected in the range of about 0.5 to about 5.0 percent by weight of the monomers A and B, although not limited. The surfactant can be an anionic surfactant, although not limited, and can be selected in the range of about 0.7 to about 5.0 percent by weight of the aqueous phase. For example, the monomers are:polymerized under starve fed conditions as referred to in Xerox patents such as U.S. Pat. No. 6,447,974, U.S. Pat. No. 6,576,389, U.S. Pat. No. 6,617,092, and U.S. Pat. No. 6,664,017, which are hereby incorporated by reference herein in their entireties, to provide latex resin particles having a diameter in the range of about 100 to about 300 nanometers. The molecular weight of the latex resin A can be, for example, about 30,000 to about 37,000 although not limited. The onset glass transition temperature (Tg) of the resin A is about 46° C. to about 56° C., about 48° C. to about 54° C., or about 51° C., although not limited. The amount of carboxylic acid groups can be selected at about 0.05 to about 5.0 parts per hundred of the resin monomers A and B. The molecular weight of the resin A obtained is about 34,000, and the molecular number is about 11,000, although not limited, providing a non cross linked latex resin A having a pH of about 2.0.

A high Tg non cross linked latex resin (resin B) can be selected comprising styrene:butylacrylate:beta-carboxyethyl acrylate, again termed herein monomers A, B, and C, by an emulsion polymerization, in the presence of initiator, a chain transfer agent, and surfactant. In embodiments, the composition of the monomers A:B:C can be selected as comprising about 70% to about 90% styrene, about 10% to about 30% butylacrylate, and about 0.05 parts per hundred to about 10 parts per hundred beta-carboxyethyl acrylate, or about 81.7% styrene, about 18.3% butyl acrylate, and about 3.0 parts per hundred beta-carboxyethyl acrylate, although not limited to the particular monomer range or type. The amounts of initiator, such as sodium or ammonium persulfate, although not limited, can be selected, for example, in the range of about 0.5 to about 3.0 percent by weight of the monomers. The amount of chain transfer agent utilized can be selected, for example, in the range of about 0.5 to about 3.0 percent by weight based upon the weight of the monomers A and B. The surfactant utilized can be an anionic surfactant, although not limited, and can be selected in the range of about 0.7 to about 5.0 percent by weight of the aqueous phase. The emulsion polymerization is conducted under a starve fed polymerization as referenced, for example, in the Xerox patents referred to above, to provide latex resin particles which are selected in the size range of about 100 nanometers to about 300 nanometers volume average particle diameter. The molecular weight of the latex resin B is about 30,000 to about 40,000, or about 34,000, the molecular number is about 11,000, although not limited, providing a non cross linked latex resin B having a pH of about 2.0. The onset Tg of the high Tg resin B is about 5° C. to about 10° C. higher than the Tg of resin A, or alternately, about 54° C. to about 65° C., about 56° C. to about 64° C., or about 59° C., although not limited. The amount of carboxylic acid groups can be selected at about 0.05 to about 5.0 parts per hundred of the resin monomers A and B.

Examples of anionic surfactants suitable for use in the resin latex dispersion can include, for example, sodium dodecylsulfate (SDS), sodium dodecylbenzene sulfonate, sodium dodecylnaphthalene sulfate, dialkyl benzenealkyl, sulfates and sulfonates, adipic acid, available from Aldrich, NEOGEN RK™, NEOGEN SC™ from Kao, and the like. An effective concentration of the anionic surfactant generally employed can be, for example, from about 0.01 to about 10 percent by weight, and more specifically, from about 0.1 to about 5 percent by weight of monomers used to prepare the toner polymer resin.

Examples of nonionic surfactants that can be included in the resin latex dispersion include, for example, polyvinyl alcohol, polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxypoly(ethyleneoxy)ethanol, available from Rhodia as IGEPAL CA-210™, IGEPAL CA-520™, IGEPAL CA-720™, IGEPAL CO-890™, IGEPAL CO-720™, IGEPAL CO-290™, IGEPAL CA-210™, ANTAROX 890™ and ANTAROX 897™. A suitable concentration of the nonionic surfactant can be, for example, from about 0.01 to about 10 percent by weight, or from about 0.1 to about 5 percent by weight of monomers used to prepare the toner polymer resin. The pigment dispersion can comprise pigment particles dispersed in an aqueous medium with a nonionic dispersant/surfactant. A dispersant having the same polarity as that of the resin latex dispersion can also be used.

Examples of additional surfactants, which may be added optionally to the aggregate suspension prior to or during the coalescence to, for example, prevent the aggregates from growing in size, or for stabilizing the aggregate size, with increasing temperature can be selected from anionic surfactants such as sodium dodecylbenzene sulfonate, sodium dodecylnaphthalene sulfate, dialkyl benzenealkyl, sulfates and sulfonates, adipic acid, available from Aldrich, NEOGEN R™, NEOGEN SC™ available from Kao, and the like, among others. These surfactants can also be selected from nonionic surfactants such as polyvinyl alcohol, polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxypoly(ethyleneoxy) ethanol, available from Rhone-Poulenac as IGEPAL CA-210™, IGEPAL CA-520™, IGEPAL CA-72™, IGEPAL CO-890™, IGEPAL CO-720™, IGEPAL CO-290™, IGEPAL CA-210™, ANTAROX 890™ and ANTAROX 897™. For example, an effective amount of the anionic or nonionic surfactant generally employed as an aggregate size stabilization agent is, for example, about 0.01 percent to about 10 percent or about 0.1 percent to about 5 percent, by weight of the reaction mixture.

Examples of the acids that can be utilized include, for example, nitric acid, sulfuric acid, hydrochloric acid, acetic acid, citric acid, trifluro acetic acid, succinic acid, salicylic acid and the like, and which acids are in embodiments utilized in a diluted form in the range of about 0.5 to about 10 weight percent by weight of water or in the range of about 0.7 to about 5 weight percent by weight of water.

In embodiments, the toner process utilizes a wax wherein the wax can be selected from, for example, an alkylene wax, a polyethylene wax, a polypropylene wax, a paraffin wax, a Fischer Tropsch wax, or mixtures thereof; further, for example, the wax can comprises a wax dispersion comprising a wax having a particle size of about 100 to about 500 nanometers, water, an anionic surfactant, and optionally a nonionic surfactant, although not limited. A wax dispersion can be selected, for example, in which the wax is a paraffin wax or a polyethylene wax, having, for example, a melting point between about 70 C to about 100 C, or about 85 C to about 95 C, although not limited to this range. The surfactant utilized to disperse the wax is an anionic surfactant, although not limited. The amount of wax can be selected to comprise about 5% to about 15% by weight based upon the weight of the final toner particle.

Examples of waxes include polyethylene, polypropylene, Fischer-Tropsch waxes, paraffin, such as, for example, wax emulsions such as for example FNP-0092® available from Nippon Seiro comprising a Fischer-Tropsch wax containing 42 carbon atoms. Further examples of wax suitable for the present toner compositions include, but are not limited to, alkylene waxes such as alkylene wax having about 1 to about 25 carbon atoms, polyethylene, polypropylene or mixtures thereof The wax is present, for example, in an amount of about 6% to about 15% by weight based upon the total weight of the composition. Examples of waxes include those as illustrated herein, such as those of the aforementioned co-pending applications, polypropylenes and polyethylenes commercially available from Allied Chemical and Petrolite Corporation, wax emulsions available from Michaelman Inc. and the Daniels Products Company, Epolene N-15™ commercially available from Eastman Chemical Products, Inc., Viscol 550-P™, a low weight average molecular weight polypropylene available from Sanyo Kasei K. K., and similar materials. The commercially available polyethylenes possess, it is believed, a molecular weight (Mw) of about 1,000 to about 5,000, and the commercially available polypropylenes are believed to possess a molecular weight of about 4,000 to about 10,000. Examples of functionalized waxes include amines, amides, for example Aqua Superslip 6550™, Superslip 6530™ available from Micro Powder Inc., fluorinated waxes, for example Polyfluo 190™, Polyfluo 200™, Polyfluo 523XF™, Aqua Polyfluo 411™, Aqua Polysilk 19™, Polysilk 14™ available from Micro Powder Inc., mixed fluorinated, amide waxes, for example Microspersion 19™ also available from Micro Powder Inc., imides, esters, quaternary amines, carboxylic acids or acrylic polymer emulsion, for example Joncryl 74™, 89™, 130™, 537™, and 538™, all available from SC Johnson Wax, chlorinated polypropylenes and polyethylenes available from Allied Chemical and Petrolite Corporation and SC Johnson Wax.

In embodiments, the wax comprises a wax in the form of a dispersion comprising, for example, a wax having a particle diameter of about 100 nanometers to about 500 nanometers or about 100 nanometers to about 300 nanometers, water, and an anionic surfactant or a polymeric stabilize, and optionally a nonionic surfactant. In embodiments, the wax is included in amounts such as about 6 to about 15 weight percent. In embodiments, the wax comprises polyethylene wax particles, such as Polywax® 725, commercially available from Baker Petrolite, although not limited thereto, having a particle diameter in the range of about 100 to about 500 nanometers, although not limited. The surfactant used to disperse the wax is an anionic surfactant, although not limited thereto, such as, for example, Neogen RK™ commercially available from Kao Corporation or TAYCAPOWER BN2060 commercially available from Tayca Corporation.

A colorant dispersion is selected, for example, comprising a cyan, magenta, yellow, or black pigment dispersion of each color in an anionic surfactant or optionally a non-ionic dispersion to provide, for example, pigment particles having a volume average particle diameter size selected of about 50 nanometers to about 500 nanometers. The surfactant utilized to disperse each colorant, can be, for example, an anionic surfactant such as Neogen RK™, although not limited. An ultimizer equipment can be used to provide the pigment dispersion, although media mill or other means can be utilized.

Colorants herein can include, for example, pigments, dyes, mixtures of pigments and dyes, mixtures of pigments, mixtures of dyes, and the like. In embodiments, the colorant comprises carbon black, magnetite, black, cyan, magenta, yellow, red, green, blue, brown, mixtures thereof, selected for example, in an amount of about 1% to about 25% by weight based upon the total weight of the composition. It is to be understood that other useful colorants will become readily apparent to one of skill in the art based on the present disclosure.

Colorants can be selected for example in the form of a pigment dispersion comprising pigments particles having a size in the range of about 50 to about 500 nanometers, water, and an anionic surfactant or polymeric stabilizer.

In some instances, pigments are available in the wet cake or concentrated form containing water, and can be easily dispersed utilizing a homogenizer, or simply by stirring, ball milling, attrition, or media milling. In other instances, pigments are available only in a dry form, whereby dispersion in water is effected by microfluidizing using, for example, a M-110 microfluidizer or an ultimizer and passing the pigment dispersion from 1 to 10 times through the chamber, or by sonication, such as using a Branson 700 sonicator, or a homogenizer, ball milling, attrition, or media milling with the optional addition of dispersing agents such as the aforementioned ionic or nonionic surfactants. In the instance of preparing carbon black pigment or other pigment dispersion, the above techniques can also be applied in the presence of a surfactant.

Colorants that may be used include, but are not limited to, Paliogen Violet 5100 and 5890 (BASF), Normandy Magenta RD-2400 (Paul Ulrich), Permanent Violet VT2645 (Paul Ulrich), Heliogen Green L8730 (BASF), Argyle Green XP-111-S (Paul Ulrich), Brilliant Green Toner GR 0991 (Paul Ulrich), Lithol Scarlet D3700 (BASF), Toluidine Red (Aldrich), Scarlet for Thermoplast NSD Red (Aldrich), Lithol Rubine Toner (Paul Ulrich), Lithol Scarlet 4440, NBD 3700 (BASF), Bon Red C (Dominion Color), Royal Brilliant Red RD-8192 (Paul Ulrich), Oracet Pink RF (Ciba Geigy), Paliogen Red 3340 and 3871K (BASF), Lithol Fast Scarlet L4300 (BASF), Heliogen Blue D6840, D7080, K7090, K6910 and L7020 (BASF), Sudan Blue OS (BASF), Neopen Blue FF4012 (BASF), PV Fast Blue B2G01 (American Hoechst), Irgalite Blue BCA (Ciba Geigy), Paliogen Blue 6470 (BASF), Sudan II, III and IV (Matheson, Coleman, Bell), Sudan Orange (Aldrich), Sudan Orange 220 (BASF), Paliogen Orange 3040 (BASF), Ortho Orange OR 2673 (Paul Ulrich), Paliogen Yellow 152 and 1560 (BASF), Lithol Fast Yellow 0991K (BASF), Paliotol Yellow 1840 (BASF), Novaperm Yellow FGL (Hoechst), Permanerit Yellow YE 0305 (Paul Ulrich), Lumogen Yellow D0790 (BASF), Suco-Gelb 1250 (BASF), Suco-Yellow D1355 (BASF), Suco Fast Yellow D1165, D1355 and D1351 (BASF), Hostaperm Pink E (Hoechst), Fanal Pink D4830 (BASF), Cinquasia Magenta (DuPont), Paliogen Black L9984 9BASF), Pigment Black K801 (BASF) and particularly carbon blacks such as REGAL® 330 (Cabot), Carbon Black 5250 and 5750 (Columbian Chemicals), and the like or mixtures thereof Additional useful colorants include pigments in water based dispersions such as those commercially available from Sun Chemical, for example SUNSPERSE BHD 6011 (Blue 15 Type), SUNSPERSE BHD 9312 (Pigment Blue 15), SUNSPERSE BHD 6000 (Pigment Blue 15:3 74160), SUNSPERSE GHD 9600 and GHD 6004 (Pigment Green 7 74260), SUNSPERSE QHD 6040 (Pigment Red 122), SUNSPERSE RHD 9668 (Pigment Red 185), SUNSPERSE RHD 9365 and 9504 (Pigment Red 57, SUNSPERSE YHD 6005 (Pigment Yellow 83), FLEXIVERSE YFD 4249 (Pigment Yellow 17), SUNSPERSE YHD 6020 and 6045 (Pigment Yellow 74), SUNSPERSE YHD 600 and 9604 (Pigment Yellow 14), FLEXIVERSE LFD 4343 and LFD 9736 (Pigment Black 7) and the like or mixtures thereof. Other useful water based colorant dispersions include those commercially available from Clariant, for example, HOSTAFINE Yellow GR, HOSTAFINE Black T and Black TS, HOSTAFINE Blue B2G, HOSTAFINE Rubine F6B and magenta dry pigment such as Toner Magenta 6BVP2213 and Toner Magenta EO2 which can be dispersed in water and/or surfactant prior to use.

Other useful colorants include, for example, magnetites, such as Mobay magnetites MO8029, MO8960; Columbian magnetites, MAPICO BLACKS and surface treated magnetites; Pfizer magnetites CB4799, CB5300, CB5600, MCX6369; Bayer magnetites, BAYFERROX 8600, 8610; Northern Pigments magnetites, NP-604, NP-608; Magnox magnetites TMB-100 or TMB-104; and the like or mixtures thereof Specific additional examples of pigments include phthalocyanine HELIOGEN BLUE L6900, D6840, D7080, D7020, PYLAM OIL BLUE, PYLAM OIL YELLOW, PIGMENT BLUE 1 available from Paul Ulrich & Company, Inc., PIGMENT VIOLET 1, PIGMENT RED 48, LEMON CHROME YELLOW DCC 1026, E.D. TOLUIDINE RED and BON RED C available from Dominion Color Corporation, Ltd., Toronto, Ontario, NOVAPERM YELLOW FGL, HOSTAPERM PINK E from Hoechst, and CINQUASIA MAGENTA available from E.I. DuPont de Nemours & Company, and the like. Examples of magentas include, for example, 2,9-dimethyl substituted quinacridone and anthraquinone dye identified in the Color Index as CI 60710, CI Dispersed Red 15, diazo dye identified in the Color Index as CI 26050, CI Solvent Red 19, and the like or mixtures thereof. Illustrative examples of cyans include copper tetra (octadecyl sulfonamide)phthalocyanine, x-copper phthalocyanine pigment listed in the Color Index as CI74160, CI Pigment Blue, and Anthrathrene Blue identified in the Color Index as DI 69810, Special Blue X-2137, and the like or mixtures thereof. Illustrative examples of yellows that may be selected include diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33 2,5-dimethoxy-4-sulfonanilide phenylazo-4'-chloro-2,4-dimethoxy acetoacetanilide, and Permanent Yellow FGL. Colored magnetites, such as mixtures of MAPICO BLACK and cyan components may also be selected as pigments.

In embodiments the particle preparation comprises, for example, mixing the non cross linked latex resin A in the presence of a wax and colorant dispersion, such as a pigment dispersion, to which a coagulant comprising a polymetal halide, for example, polyaluminum chloride, is added while blending at high speeds such as with a polytron. The resulting mixture having a pH of about 2.0 to about 3.0 is aggregated by heating to a temperature that is below the resin Tg to provide a toner sized aggregate. High Tg non cross linked latex resin B is then optionally added to the formed aggregates. This later addition of high Tg latex resin B provides a shell over the preformed aggregates. Optionally, the pH of the mixture is then adjusted, for example by the addition of a sodium hydroxide solution to a pH of about above 3.5 to about 5.

In embodiments, the cationic coagulants that can be selected include, for example, polyaluminum chloride, polyaluminum sulfo silicate, or an alkyl benzylammonium chloride, and which coagulants are effective as aggregating agents in a pH environment of about 2 to about 3.5.

In embodiments, the complexing or sequestering component, for example organic complexing agent ethylenediaminetetra acetic acid, is then added to complex with the polymetal ion coagulant, for example, a polymetal halide, and partially remove it from the toner. The resulting pH is about 3.5 to about 6.0. At a pH of about 5.0 to about 6.0, the carboxylic acid becomes ionized to provide additional negative charge on the aggregates thereby providing stability and preventing the particles from further growth or an increase in geometric size distribution when heated above the Tg of the latex resin. Optionally, the pH can be adjusted using a base to above about 6.0 to about 7.5. The temperature is raised to a temperature above the resin Tg, for example, to about 95° C., to coalesce or fuse the aggregates to provide a composite toner particle upon further heating. The fused particles are measured for shape factor or circularity for example, using a Sysmex FPIA 2100 analyser until the desired shape is achieved, whereupon the pH is adjusted to about 7.0 and the toner slurry is continually heated at about 95° C. for a total of about 3 hours.

Introducing the sequestering or complexing component comprises in embodiments, introducing an organic complexing component or an organic complexing component. For example, an organic complexing component can be selected from the group consisting of ethylenediaminetetraacetic acid, gluconal, sodium gluconate, potassium citrate, sodium citrate, nitrotriacetate salt, humic acid, and fulvic acid; salts of ethylenediaminetetraacetic acid, gluconal, sodium gluconate, potassium citrate, sodium citrate, nitrotriacetate salt, humic acid, and fulvic acid, alkali metal salts of ethylenediaminetetraacetic acid, gluconal, sodium gluconate, potassium citrate, sodium citrate, nitrotriacetate salt, humic acid, and fulvic acid; sodium salts of ethylenediaminetetraacetic acid, gluconal, sodium gluconate, tartaric acid, gluconic acid, oxalic acid, polyacrylates, sugar acrylates, citric acid, potassium citrate, sodium citrate, nitrotriacetate salt, humic acid, and fulvic acid; potassium salts of ethylenediaminetetraacetic acid, gluconal, sodium gluconate, potassium citrate, sodium citrate, nitrotriacetate salt, humic acid, and fulvic acid; and calcium salts of ethylenediaminetetraacetic acid, gluconal, sodium gluconate, potassium citrate, sodium citrate, nitrotriacetate salt, humic acid, fulvic acid, calcium disodium ethylenediaminetetraacetate dehydrate, diammoniumethylenediaminetetraacetic acid, pentasodium diethylenetriaminepentaacetic acid sodium salt, trisodium N-(hydroxyethyl)-ethylenediaminetriacetate, polyasparic acid, diethylenetriamine pentaacetate, 3-hydroxy-4-pyridinone, dopamine, eucalyptus, iminodisuccinic acid, ethylenediaminedisuccinate, polysaccharide, sodium ethylenedinitrilotetraacetate, nitrilo triacetic acid sodium salt, thiamine pyrophosphate, farnesyl pyrophosphate, 2-aminoethylpyrophosphate, hydroxyl ethylidene-1,1-diphosphonic acid, aminotrimethylenephosphonic acid, diethylene triaminepentamethylene phosphonic acid, ethylenediamine tetramethylene phosphonic acid, and mixtures thereof For example, introducing the sequestering or complexing component in (vii) can comprise in embodiments introducing an organic complexing component comprising ethylenediaminetetraacetic acid, and the like.

In an alternate embodiment, an inorganic complexing or sequestering component, such as, for example, sodium silicate, is added to complex with the polymetal halide and partially remove it from the toner, resulting in a mixture having a pH of about 3 to about 7 after the inorganic complexing component is introduced. Optionally the pH is adjusted to a pH of about 6 to about 7 prior to heating the resulting mixture above about the Tg of the latex resin at a pH of about 6 to about 7.

In embodiments, inorganic complexing components can be selected from the group consisting of sodium silicate, potassium silicate, magnesium sulfate silicate, sodium hexameta phosphate, sodium polyphosphate, sodium tripolyphosphate, sodium trimeta phosphate, sodium pyrophosphate, bentonite, and talc, and the like.

Organic and inorganic complexing components can be selected in an amount of about 0.01 weight percent to about 10.0 weight percent, or from about 0.02 weight percent to about 4.0 weight percent based upon the total weight of the toner.

The mixture is allowed to cool to room temperature and washed. For example, a first wash is conducted at a pH of about 10 at a temperature of about 63° C., followed by a deionized water wash at room temperature, followed by a wash at a pH of about 4.0 at a temperature of about 40° C., followed by a final deionized water wash. The toner is then dried.

In embodiments, the process provides a high gloss toner composition comprising non cross linked latex resin A, a high Tg non cross linked latex resin B, a wax and a pigment; for example, the toner comprises in embodiments about 54.4 to about 58 weight percent non cross linked resin A depending on the toner colorant selected, about 14 to about 34 or about 28 weight percent of high Tg non cross linked resin B, about 4 to about 20 or about 9.0 weight percent wax, and about 5 to about 8.6 weight percent colorant, depending on the colorant selected, and a shape factor of about 120 to about 140, although not limited to the aforementioned compositions or shape factors. A particle circularity of toner can be selected, in embodiments, at about 0.930 to about 0.980, as measured on a Sysmex FIA 2100. The molecular weight of the composite toner particle can be, for example, about 25,000 to about 50,000 or about 35,000, the molecular number can be about 7,000 to about 15,000, or about 10,000, and the onset Tg can be, for example, about 45° C. to about 65° C., or about 51° C.

The toner particles obtained may also include known charge additives in effective amounts such as, for example, from about 0.1 to about 5 weight percent, such as alkyl pyridinium halides, bisulfates, the charge control additives of U.S. Pat. Nos. 3,944,493; 4,007,293; 4,079,014; 4,394,430 and 4,560,635, the disclosures of which are totally incorporated herein by reference, and the like. Surface additives that can be added to the toner compositions after washing or drying include, for example, metal salts, metal salts of fatty acids, colloidal silicas, metal oxides, mixtures thereof, and the like, which additives are usually present in an amount of from about 0.1 to about 2 weight percent, reference U.S. Pat. Nos. 3,590,000, 3,720,617, 3,655,374 and 3,983,045, the disclosures of which are totally incorporated herein by reference. Examples of suitable additives include zinc stearate and AEROSIL R972® available from Degussa in amounts of from about 0.1 to about 2 percent which can be added during the aggregation process or blended into the formed toner product.

Also provided herein are developer and imaging processes, including a process for preparing a developer comprising preparing a toner composition with the toner processes illustrated herein and mixing the resulting toner composition with a carrier. Developer compositions can be prepared by mixing the toners obtained with the processes of the present disclosure with known carrier particles, including coated carriers, such as steel, ferrites, and the like, reference U.S. Pat. Nos. 4,937,166 and 4,935,326, the disclosures of which are totally incorporated herein by reference, using, for example from about 2 percent toner concentration to about 8 percent toner concentration. The carriers selected may also contain dispersed in the polymer coating a conductive compound, such as a conductive carbon black and which conductive compound is present in various suitable amounts, such as from about 15 to about 65, or from about 20 to about 45, weight percent.

Imaging methods are also envisioned as part of the present disclosure, reference for example a number of the patents mentioned herein, and U.S. Pat. No. 4,265,660, the disclosure of which is totally incorporated by reference herein. Imaging processes comprise, for example, preparing an image with a xerographic device comprising a charging component, an imaging component, a photoconductive component, a developing component, a transfer component, and a fusing component; and wherein the development component comprises a developer prepared by mixing a carrier with a toner composition prepared with the toner processes illustrated herein; an imaging process comprising preparing an image with a xerographic device comprising a charging component, an imaging component, a photoconductive component, a developing component, a transfer component, and a fusing component; wherein the development component comprises a developer prepared by mixing a carrier with a toner composition prepared with the toner processes illustrated herein; and wherein the xerographic device comprises a high speed printer, a black and white high speed printer, a color printer, or combinations thereof.

EXAMPLES

The following Examples are being submitted to further define various species of the present disclosure. These Examples are intended to be illustrative only and are not intended to limit the scope of the present disclosure. Also, parts and percentages are by weight unless otherwise indicated.

Example I

A latex emulsion designated as "resin A" comprising polymer particles generated from the emulsion polymerization of styrene, n-butyl acrylate and beta-carboxyethyl acrylate (beta-CEA) was prepared as follows. A surfactant solution comprising 605 grams of alkyldiphenyloxide disulfonate anionic emulsifier (Dowfax™ 2A1 available from Dow) and 387 kilograms deionized water was prepared by mixing for 10 minutes in a stainless steel holding tank. The holding tank was then purged with nitrogen for 5 minutes before transferring into the main reactor. The reactor was then continuously purged with nitrogen while being stirred at 100 revolutions per minute (RPM). The reactor was then heated at a controlled rate up to a temperature of 80° C. and held there. Separately, 6.1 kilograms of ammonium persulfate initiator was dissolved in 30.2 kilograms of deionized water.

Separately, the monomer emulsion was prepared in a separate reactor the following manner 311.4 kilograms of styrene, 95.6 kilograms of butyl acrylate, 12.21 kilograms of beta-carboxyethyl acrylate, 2.88 kilograms of 1-dodecanethiol, 1.42 kilograms dodecanediol diacrylate (ADOD), 8.04 kilograms alkyldiphenyloxide disulfonate anionic emulsifier (Dowfax™ 2A1 available from Dow), and 193 kilograms of deionized water were mixed in a separate reactor to form an emulsion. 1% of the prepared monomer emulsion. was then slowly fed into the main reactor containing the aqueous surfactant solution at 80° C. while being purged with nitrogen to form the toner seed particles. The initiator solution was then slowly charged into the main reactor and after 10 minutes the rest of the monomer emulsion was continuously fed into the main reactor at a rate of 0.5%/minute using a metering pump. Once all of the monomer emulsion was charged into the main reactor, the temperature was held at 80° C. for an additional 2 hours to complete the reaction. Full cooling was then applied and the main reactor temperature was reduced to 35° C. The product was collected into a holding tank and then dried to yield a latex resin A having the following molecular properties. Mw (molecular weight)=35,419; Mn (molecular number)=11,354; onset Tg (glass transition temperature)=51.0° C.

A latex emulsion designated as "resin B" comprising polymer particles generated from the emulsion polymerization of styrene, n-butyl acrylate, and beta-carboxyethyl acrylate was prepared as follows. A surfactant solution comprising 605 grams of alkyldiphenyloxide disulfonate anionic emulsifier (Dowfax™ 2A1 available from Dow) and 387 kilograms deionized water was prepared by mixing for 10 minutes in a stainless steel holding tank. The holding tank was then purged with nitrogen for 5 minutes before transferring into the main reactor. The main reactor was then continuously purged with nitrogen while being stirred at 100 RPM. The main reactor was then heated at a controlled tare to a temperature of 80° C. and held there. Separately, 6.1 kilograms of ammonium persulfate initiator was dissolved in 30.2 kilograms of deionized water.

Separately, a monomer emulsion was prepared in the following manner. 332.5 kilograms of styrene, 74.5 kilograms of butyl acrylate, 12.21 kilograms of beta-carboxyethyl acrylate, 2.88 kilograms kilograms of 1-dodecanethiol, 1.42 kilograms dodecanediol diacrylate (ADOD), 8.04 kilograms alkyldiphenyloxide disulfonate anionic emulsifier (Dowfax™ 2A1 available from Dow), and 193 kilograms of deionized water were mixed to form an emulsion. 1% of the above emulsion was then slowly fed into the main reactor containing the aqueous surfactant phase at a temperature of 80° C. under nitrogen purse to form the "seeds." The initiator solution was then slowly charged into the main reactor and after 10 minutes the rest of the monomer emulsion was continuously fed into the main reactor at a rate of 0.5% per minute using a metering pump. Once al of the monomer emulsion was charged into the main reactor, the temperature was held at 80° C. for an additional 2 hours to complete the reaction. Full cooling was then applied and the reactor temperature was reduced to 35° C. The product was discharged into a holding tank and dried to yield a latex resin B having the following molecular properties. Mw=33,700; Mn=10,900, and onset Tg=58.6° C.

Example II 286.9 grams of resin A latex having a solids loading of 41.4 weight % and 60.49 grams of a wax emulsion comprising a purified paraffin wax containing $C_{42}$ (FNP-0092® available from Nippon Seiro) having a solids loading of 30.50 weight % were added to 613.5 grams of deiionized water in a vessel and stirred using an IKA Ultra Turrax® T50 homogenizer operating at 4,000 RPM. Thereafter, 64.1 grams of cyan pigment dispersion PB 15:3 available from Sun Chemical as Sun Pigment W51924 having a solids loading of 17 weight % were added to the reactor, followed by dropwise addition of 36 grams of a flocculent mixture containing 3.6 grams of polyaluminum chloride mixture and 32.4 grams of a 0.02 molar nitric acid solution. As the flocculent mixture was added dropwise the homogenizer speed was increased to 5,200

RPM and the reactor contents were homogenized for an additional 5 minutes. Thereafter, the mixture was heated to a temperature of 52° C. at a rate of 1° C. per minute and held at 52° C. for a period of about 1.5 to about 2 hours resulting in a cyan toner particle having a volume average particle size of 5 microns as measured with a Coulter Counter. During the heating period, the stirred was run at about 250 RPM. 10 minutes after the set temperature of 49° C. was reached, the stirred speed was reduced to about 220 RPM.

134.6 grams of latex resin B having a solids loading of 41.6 weight % was added to the reactor mixture and allowed to aggregate for an additional period of about 30 minutes at 51° C. to yield a cyan toner particle having a volume average particle diameter of about 5.7 microns as measured with a Coulter Counter. The pH of the reactor mixture was adjusted to pH 4.0 by using a 1.0 M sodium hydroxide solution added to 4.82 grams of ethylenediaminetetra acetic acid (EDTA) Versene™ 100 available from Dow having a solids loading of 39 weight %. Thereafter, the reactor mixture was heated at a rate of 1° C. per minute to a temperature of 95° C. Following this, the reactor mixture was gently stirred at 95° C. for 3 hours to enable the particles to coalesce and spherodize. After 1 hour of coalescence, the pH of the reactor was adjusted to pH 7.0 and the reactor mixture was gently stirred for the remaining 2 hours. The reactor heater was then turned off and the reactor mixture was allowed to cool to room temperature at a rate of 1° C. per minute. The resulting toner mixture was comprised of about 16.7 percent toner, 0.25 percent anionic surfactant, and about 82.9 percent water, where all percents are by weight based on the total weight of the toner mixture. The toner of this mixture comprised about 58 weight percent styrene/acrylate polymer resin A, about 28 weight percent styrene/acrylate polymer resin B, about 5 weight percent PB 15:3™ pigment, and about 9 weight percent FNP-0092™ wax, and had a volume average particle diameter of about 5.7 microns, and a grain size distribution (GSD) of about 1.19. The particles were washed 6 times, wherein the first wash was conducted at a pH of 10 at 63° C., followed by 3 washes with deionized water at room temperature, one wash carried out at a pH of 4.0 at 40° C., and finally the last wash with deionized water at room temperature. The final measured aluminum concentration in the dry toner was 265 PPM as measured by Inductively Coupled Plasma Emission Spectroscopy (ICP).

Example III 269.1 grams of resin A latex having a solids loading of 41.4 weight % and 60.49 grams of wax emulsion (FNP-0092®) having a solids loading of 30.50 weight % were added to 559.0 grams of deionized waster in a vessel and stirred using an IKA Ultra Turrax® T50 homogenizer operating at 4,000 RPM. Thereafter, 53.47 grams of magenta pigment dispersion W92930 available from Sun Chemical (PR122) having a solids loading of 17.53 weight % and 86.32 grams of magenta pigment dispersion 0104-1 available from Sun Chemical (PR238) having a solids loading of 10.86 weight % were added to the reactor, followed by dropwise addition of 36 grams of a flocculent mixture containing 3.6 grams polyaluminum chloride mixture and 32.4 grams of a 0.02 molar nitric acid solution. As the flocculent mixture was added dropwise, the homogenzier speed was increased to 5,200 RPM and the mixture was homogenized for an additional 5 minutes. Thereafter, the mixture was heated at a rate of 1° C. per minute to a temperature of 51° C. and held there for a period of about 1.5 to about 2 hours resulting in a magenta toner particle having a volume average particle diameter of 5 microns as measured with a Coulter Counter. During the heating up period, the stirrer was run at about 250 RPM. Ten minutes after the set temperature of 49° C. was reached, the stirrer speed was reduced to about 220 RPM.

134.6 grams of latex resin B having a solids loading of 41.6 weight % was added to the reactor mixture and allowed to aggregate for an additional period of about 30 minutes at 51° C. resulting in a magenta toner having a volume average particle diameter of about 5.7 microns. The pH of the reactor mixture was adjusted to a pH of 4.0 with a 1.0 molar sodium hydroxide solution followed by the addition of 4.82 grams of ethylenediaminetetra acetic acid (Versene™ 100 available from Dow) having a solids loading of 39 weight %. Thereafter, the reactor mixture was heated at a rate of 1° C. per minute to a temperature of 95° C. Following this, the reactor mixture was gently stirred at 95° C. for 3 hours to enable the particles to coalesce and spherodize. The reactor heater was then turned off and the reactor mixture was allowed to cool to room temperature at a rate of 1° C. per minute. The resulting toner mixture was comprised of about 16.7 percent of toner, 0.25 percent of anionic surfactant, and about 82.9 percent water, all by weight based on the total weight of the toner mixture. The toner of this mixture comprised about 54.5 weight percent styrene/acrylate polymer resin A, about 28 weight percent styrene/acrylate polymer resin B, about 4.3 weight percent PR122 pigment, about 4.2 weight percent PR238, and about 9 weight percent FNP-0092 wax, and had a volume average particle diameter of about 5.7 microns, and a GSD of about 1.19. The particles were washed 6 times as follows. The first wash was conducted at a pH of 10 and a temperature of 63° C., followed by three washes with deionized water at room temperature, one wash at a pH of 4.0 at 40° C., and finally a last wash with deionized water at room temperature. The final measured aluminum concentration in the dry toner was 211 PPM as measured by ICP.

Example IV 281.9 grams of latex resin A having a solids loading of 41.4 weight % and 60.49 grams of wax emulsion (FNP-0092® available from Nippon Seiro) having a solids loading of 30.50 weight % were added to 605.0 grams of deionized water in a vessel and stirred using and IKA Ultra Turrax® T50 homogenizer operating at 4,000 RPM. Thereafter, 78.5 grams of yellow pigment dispersion 0103Y13 available from Sun Chemical (PY74) having a solids loading of 16.67 weight % were added to the reactor, followed by dropwise addition of 36 grams of a flocculent mixture containing 3.6 grams of a polyaluminum chloride mixture and 32.4 grams of a 0.02 molar nitric acid solution. As the flocculent mixture was added dropwise, the homogenizer speed was increased to 5,200 RPM and homogenized for an additional 5 minutes. Thereafter, the mixture was heated at a rate of 1° C. per minute to a temperature of 51° C. and held there for a period of about 1.5 to abut 2 hours resulting in a volume average particle diameter of 5 microns as measured with a Coulter Counter. During the heating up period, the stirrer was run at about 250 RPM. Ten minutes after the set temperature of 49° C. was reached, the stirrer speed was reduced to about 220 RPM.

134.6 grams of latex resin B having a solids loading of 41.6 weight % was added to the reactor mixture and allowed to aggregate for an additional period of about 30 minutes at a temperature of 51° C. resulting in a toner having a volume average particle diameter of about 5.7 microns. The pH of the reactor mixture was adjusted to pH 4.0 with a 1.0 molar sodium hydroxide solution followed by the addition of 4.82 grams of ethylenediaminetetra acetic acid (Versene™ 100 available from Dow) having a solids loading of 39 weight %. Thereafter, the reactor mixture was heated at a rate of 1° C. per minute to a temperature of 95° C. Following this, the reactor mixture was gently stirred at 95° C. for 3 hours to enable the particles to coalesce and spherodize. After 1.5 hours of coalescence, the pH of the reactor was adjusted to a pH of 7.0 and the reactor mixture was gently stirred for the remaining 1.5 hours. The reactor heater was then turned off and the reactor mixture was allowed to cool to room temperature at a rate of 1° C. per minute. The resulting toner mixture comprised about 16.7 percent toner, about 0.25 percent anionic surfactant, and about 82.9 percent water, all by weight based upon the total weight of the toner mixture. The toner of this mixture comprised about 57 weight percent of styrene/acrylate polymer resin A, about 28 weight percent of styrene/acrylate polymer resin B, about 6 weight percent of PY74 pigment, and about 9 weight percent FNP-0092® wax, had a volume average particle diameter of about 5.7 microns, and a GSD of about 1.19. The particles were washed 6 times as follows. A first was conducted at a pH of 10 at 63° C., followed by three washes with deionized water at room temperature, one wash carried out at a pH of 4.0 at 40° C., a final wash with deionized water at room temperature. The final measured aluminum concentration in the dry toner was 274 PPM as measured by ICP.

Example V 274.5 grams of latex resin A having a solids loading of 41.4 weight % and 60.49 grams of a wax emulsion (FNP-0092® available from Nippon Seiro) having a solids loading of 30.50 weight % were added to 597.6 grams of deionized water in a vessel and stirred using an IKA Ultra Turrax® T50 homogenizer operating at 4,000 RPM. Thereafter, 81.91 grams of black pigment dispersion K18 (Regal 330™ available from Cabot Corporation) having a solids loading of 17.3 weight % and 12.82 grams of cyan pigment dispersion PB 15:3 (Sun Pigment W51924) having a solids loading of 17 weight % were added to the reactor, followed by dropwise addition of 36 grams of a flocculent mixture containing 3.6 grams of polyaluminum chloride mixture and 32.4 grams of a 0.02 molar nitric acid solution. As the flocculent mixture was added dropwise, the homogenizer speed was increased to 5,200 RPM and homogenized for an additional 5 minutes. Thereafter, the mixture was heated at a rate of 1° C. per minute to a temperature of 51° C. and held there for a period of about 1.5 to about 2 hours resulting gin a volume average particle diameter of 5 microns as measured with a Coulter Counter. During the heating up period, the stirrer was run at about 250 RPM. Ten minutes after the set temperature of 49° C. was reached, the stirrer speed was reduced to about 229 RPM.

134.6 grams of latex resin B having a solids loading of 41.6 weight % was added to the reactor mixture and allowed to aggregate for an additional period of about 30 minutes at 51° C. resulting in a volume average particle diameter of about 5.7 microns. The pH of the reactor mixture was adjusted to a pH of 4.0 with a 1.0 molar sodium hydroxide solution followed by the addition of 4.82 grams of ethylenediaminetetra acetic acid (Versene™ 100 available from Dow) having a solids loading of 39 weight %. Thereafter, the reactor mixture was heated at 1° C. per minute to a temperature of 95° C. Following this, the reactor mixture was gently stirred at 95° C. for 3 hours to enable the particles to coalesce and spherodize. After 1.5 hours of coalescence, the pH of the reactor was adjusted to a pH of 7.0 and the reactor mixture was gently stirred for the remaining 1.5 hours. The reactor heater was then turned off and the reactor mixture was allowed to cool to room temperature at a rate of 1° C. per minute. The resulting toner mixture was comprised of about 16.7 percent toner, 0.25 percent anionic surfactant, and about 82.9 percent water, all by weight based upon the total weight of the toner mixture. The toner of the mixture comprised about 55.5 weight percent of styrene/acrylate polymer resin A, about 28 weight percent of styrene/acrylate polymer resin B, about 6.5 weight percent of Regal 330™ black pigment, about 1 weight percent pf PB 15:3 cyan pigment, and about 9 weight percent FNP-0092® wax, and had a volume average particle diameter of about 5.7 microns and a GSD of about 1.19. The particles were washed 6 times as follows. A first wash was conducted at a pH of 10 at 63° C., followed by 3 washes with deionized water at room temperature, one wash at a pH of 4.0 at 40° C., and a final wash with deionized water at room temperature. The final measured aluminum concentration in the dry toner was 280 parts per million as measured by ICP.

Example VI 286.9 grams of latex resin A having a solids loading of 41.4 weight % and 60.49 grams of wax emulsion comprising a purified paraffin wax containing $C_{42}$ having a solids loading of 30.50 weight % (FNP-0092® available from Nippon Seiro) were added to 613.5 grams of deionized water in a vessel and stirred using an IKA Ultra Turrax® T50 homogenizer operating at 4,000 RPM. Thereafter, 64.1 grams of cyan pigment dispersion PB15:3 (Sun Pigment W51924™) having a solids loading of 17 weight % were added to the reactor, followed by the dropwise addition of 36 grams of a flocculent mixture containing 3.6 grams of polyaluminum chloride mixture and 32.4 grams of a 0.02 molar nitric acid solution. As the flocculent mixture was added dropwise, the homogenizer speed was increased to 5,200 RPM and homogenized for an additional 5 minutes. Thereafter, the mixture is heated at a rate of 1° C. per minute to a temperature of 51° C. and held there for a period of about 1.5 to about 2 hours resulting in a volume average particle diameter of 5 microns as measured with a Coulter Counter. During the heating up period, the stirrer was run at about 250 RPM. Ten minutes after the set temperature of 49° C. was reached, the stirrer speed was reduced to about 220 RPM.

134.6 grams of latex resin B having a solids loading of 41.6 weight percent was added to the reactor mixture and allowed to aggregate for an additional period of about 30 minutes at 51° C. resulting in a volume average particle diameter of about 5.7 microns. The pH of the reactor mixture was adjusted to a pH of 4.0 with a 1.0 molar sodium hydroxide solution followed by the addition of 10.15 grams of sodium silicate (available from for example Sigma Aldrich) having a $SiO_2$ concentration of 27 weight %. The resulting pH was about 6.5. The pH was then decreased to 5.6 using a 0.02 molar $HNO_3$ solution. Thereafter, the reactor mixture was heated at a rate of 1° C. per minute to a temperature of 95° C. Following this, the reactor mixture was gently stirred at 95° C. for 3 hours to enable the particles to coalesce and spherodize. After 1 hour of coalescence, the pH of the reactor mixture was adjusted to a pH of 7.0 and the reactor mixture was gently stirred for the remaining 2 hours. The reactor heater was then turned off and the reactor mixture was allowed to cool to room temperature at a rate of 1° C. per minute. The resulting toner mixture was comprised of about 16.7 percent toner, 0.25 percent anionic surfactant, and about 82.9 percent water, all by weight based upon the total weight of the toner mixture. The toner of this mixture comprised about 58 weight percent styrene/acrylate polymer resin A, about 29 weight percent of styrene/acrylate polymer resin B, and 5 weight percent of PB 15:3 pigment, and about 9 weight percent FNP-0092® wax, and had a volume average particle diameter of about 5.7 microns and a GSD of about 1.19. The particles were washed 6 times as follows. The first wash was conducted at a pH of 10 at 63° C., followed by 3 washes with deionized water at room temperature, one wash carried out at a pH of 4.0 at 40° C., and a final wash with deionized water at room temperature. The final measured aluminum concentration in the dry toner was 235 parts per million as measured by ICP.

Example VII 269.1 grams of latex resin A having a solids loading of 41.4 weight % and 60.49 grams of a wax emulsion having a solids loading of 30.50 weight % (FNP-0092® available from Nippon Seiro) were added to 559.0 grams of deionized water in a vessel and stirred using an IKA Ultra Turrax® T50 homogenizer operating at 4,000 RPM. Thereafter, 53.47 grams of magenta pigment dispersion PR122 (W92930™ available from Sun Chemical) having a solids of 17.53 weight % and 86.32 grams of magenta pigment dispersion PR238 (0104-1™ available from Sun Chemical) having a solids of 10.86 weight % were added to the reactor, followed by dropwise addition of 36 grams of a flocculent mixture containing 3.6 grams of polyaluminum chloride mixture and 32.4 grams of a 0.02 molar nitric acid solution. As the flocculent mixture was added dropwise, the homogenizer speed was increased to 5,200 RPM and the mixture was homogenized for an additional 5 minutes. Thereafter, the mixture was heated at a rate of 1° C. per minute to a temperature of 51° C. and held there for a period of about 1.5 to about 2 hours resulting in a volume average particle diameter of 5 microns as measured with a Coulter Counter. During the heating up period, the stirrer was run at about 250 RPM. Ten minutes after the set temperature of 49° C. was reached, the stirrer speed was reduced to about 220 RPM.

134.6 grams of latex resin B having a solids loading of 41.6 weight % was added to the reactor mixture and allowed to aggregate for an additional period of about 30 minutes at 51° C. resulting in a volume average particle diameter of about 5.7 microns. The pH of the reactor mixture was adjusted to a pH of 4.0 with a 1.0 molar solution of sodium hydroxide followed by the addition of 10.15 grams of sodium silicate having a $SiO_2$ concentration of 27 weight %. The resulting pH was about 6.5 The pH was then decreased to about 5.6 using a 0.02 molar $HNO_3$ solution. Thereafter, the reactor mixture was heated at a rate of 1° C. per minute to a temperature of 95° C. Following this, the reactor mixture was gently stirred at 95° C. for 3 hours to enable the particles to coalesce and spherodize. The reactor heater was then turned off and the reactor mixture was allowed to cool to room temperature at a rate of 1° C. per minute. The resulting toner mixture was comprised of 16.7 percent toner, 0.25 percent anionic surfactant, and about 82.9 percent water, all by weight based upon the total weight of the toner mixture. The toner of this mixture comprised about 54.5 weight percent styrene/acrylate polymer resin A, about 28 weight percent styrene/acrylate polymer resin B, about 4.3 weight percent PR122 magenta pigment, about 4.3 weight percent PR238 magenta pigment, about 9 weight percent FNP-0092® wax, had a volume average particle diameter of about 5.7 microns, and a GSD of about 1.19. The particles were washed 6 times as follows. A first wash was conducted at a pH of 10 at 63° C., followed by 3 washes with deionized water at room temperature, one wash carried out at a pH of about 4.0 at 40° C., and a final wash with deionized water at room temperature. The toner was isolated and dried. The final measured aluminum concentration in the dry toner was 195 parts per million as measured by ICP.

Example VIII 281.9 grams of latex resin A having a solids loading of 41.4 weight % and 60.49 grams of wax emulsion (FNP-0092® available from Nippon Seiro) having a solids loading of 30.50 weight % were added to 605 grams of deionized water in a vessel and stirred using an IKA Ultra Turrax® T50 homogenizer operating at 4,000 RPM. Thereafter, 78.5 grams of yellow pigment dispersion PY74 (0103Y13™ available from Sun Chemical) having a solids loading of 16.67 weight % were added to the reactor, followed by dropwise addition of 36 grams of a flocculent mixture containing 3.6 grams of a polyaluminum chloride mixture and 32.4 grams of a 0.02 molar nitric acid solution. As the flocculent mixture was added dropwise, the homogenizer speed was increased to 5,200 RPM and homogenized for an additional 5 minutes. Thereafter, the mixture was heated at 1° C. per minute to a temperature of 51° C. and held there for a period of about 1.5 to about 2 hours resulting in a volume average particle diameter of 5 microns as measured with a Coulter Counter. During the heating up period, the stirrer was run at about 250 RPM. Ten minutes after the set temperature of 49° C. was reached, the stirrer speed was reduced to about 220 RPM.

134.6 grams of latex resin B having a solids loading of 41.6 weight % was added to the reactor mixture and allowed to aggregate for an additional period of about 30 minutes at 51° C. resulting in a volume average particle diameter of about 5.7 microns. The pH of the reactor mixture was adjusting to 4.0 with a 1.0 molar sodium hydroxide solution followed,by the addition of 10.15 grams of sodium silicate having a $SiO_2$ concentration of 27 weight %. The resulting pH was about 6.5. The pH was then decreased to about 5.6 using a 0.02 molar $HNO_3$ solution. Thereafter, the reactor mixture was heated at a rate of 1° C. per minute to a temperature of 95° C. Following this, the reactor mixture was gently stirred at 95° C. for 3 hours to enable the particles to coalesce and spherodize. After 1.5 hours of coalescence, the pH of the reactor was adjusted to a pH of about 7.0 and the reactor mixture was gently stirred for the remaining 1.5 hours. The reactor heater was then turned off and the reactor mixture was allowed to cool to room temperature at a rate of 1° C. per minute. The resulting toner mixture was comprised of about 16.7 percent toner, 0.25 percent anionic surfactant, and about 82.9 percent water, all by weight based upon the total weight of the toner mixture. The toner of this mixture comprised about 57 weight percent styrene/acrylate polymer resin A, about 28 weight percent styrene/acrylate polymer resin B, about 6 weight percent PY74 pigment, about 9 weight percent FNP-0092® wax, a volume average particle diameter of about 5.7 microns, and a GSD of about 1.19. The particles were washed 6 times as follows. A first wash was conducted at a pH of 10 at 63° C., followed by 3 washes with deionized water at room temperature, one wash carried out at a pH of about 4.0 at 40° C., and a final wash with deionized water at room temperature. The final measured aluminum concentration in the dry toner was 256 parts per million as measured by ICP.

It will be appreciated that various of the above-discussed and other features and functions, or alternatives thereof, may be desirably combined into many other different systems or applications. Also that various presently unforeseen or unanticipated alternatives, modifications, variations or improvements therein ay be subsequently made by those skilled in the art which are also intended to be encompassed by the following claims.

The invention of cliamed is:

1. A toner process comprising:

aggregating a latex emulsion comprising a resin, a colorant and a wax using an amount of metal ion coagulant to provide particles;

heating the particles to provide micron size aggregates;

optionally adding a second resin emulsion;

adding a sequestering component and a base to remove the metal ion in a controlled manner;

further heating the mixture to provide toner particles; and optionally, isolating the toner particles;

wherein the amount of metal ion coagulant selected is represented by the following equation:

$$M_{Seq}=M_{IMC}-M_{RM}$$

wherein $M_{Seq}$ represents the number of moles of sequestering agent, $M_{IMC}$ represents the initial moles of metal in the coagulant, and $M_{RM}$ represents the desired final coagulant metal concentration in moles;

resulting in toner particles comprising resin, colorant and wax and which toner possesses a coagulant metal concentration of about 100 to about 900 parts per million based on the total weight of the toner.

2. The process of claim 1, resulting in toner particles comprising resin, colorant, and which toner possesses a final coagulant metal concentration of about 150 to about 500 parts per million based on the total weight of the toner particle.

3. The process of claim 1, wherein the sequestering component comprises an organic complexing component selected from the group consisting of ethylenediaminetetraacetic acid, gluconal, sodium gluconate, potassium citrate, sodium citrate, nitrotriacetate salt, humic acid, and fulvic acid;

salts of ethylenediaminetetraacetic acid, gluconal, sodium gluconate, potassium citrate, sodium citrate, nitrotriacetate salt, humic acid, and fulvic acid, alkali metal salts of ethylenediaminetetraacetic acid, gluconal, sodium gluconate, potassium citrate, sodium citrate, nitrotriacetate salt, humic acid, and fulvic acid;

sodium salts of ethylenediaminetetraacetic acid, gluconal, sodium gluconate, potassium citrate, sodium citrate, nitrotriacetate salt humic acid, and fulvic acid;

potassium salts of ethylenediaminetetraacetic acid, gluconal, sodium gluconate, potassium citrate, sodium citrate, nitrotriacetate salt humic acid, and fulvic acid;

calcium salts of ethylenediaminetetraacetic acid, gluconal, sodium gluconate, potassium citrate, sodium citrate, nitrotriacetate salt, humic acid, fulvic acid, calcium salts of ethylenediaminetetraacetic acid, gluconal, sodium gluconate, potassium citrate, sodium citrate, nitrotriacetate salt, humic acid, fulvic acid, calcium disodium ethylenediaminetetraacetate dehydrate, diammonium-ethylenediaminetetraacetic acid, pentasodium diethylenetriaminepentaacetic acid sodium salt, trisodium N-(hydroxyethyl)-ethylenediaminetriacetate, polyasparic acid, diethylenetriamine pentaacetate, 3-hydroxy-4-pyridinone, dopamine, eucalyptus, iminodisuccinic acid, ethylenediaminedisuccinate, polysaccharide, sodium ethylenedinitrilotetraacetate, nitrilo triacetic acid sodium salt, thiamine pyrophosphate, farnesyl pyrophosphate, 2-aminoethylpyrophosphate, hydroxyl ethylidene-1,1-diphosphonic acid, aminotrimethylene-phosphonic acid, diethylene triaminepentamethylene phosphonic acid, ethylenediamine tetramethylene phosphonic acid, and mixtures thereof.

4. The process of claim 1, wherein the sequestering component comprises ethylenediaminetetraacetic acid.

5. The process of claim 1, the sequestering component is selected in an amount of from about 0.02 weight percent to about 4.0 weight percent based upon the total weight of resin, colorant, and wax.

6. The process of claim 1, wherein adding the sequestering component comprises adding an inorganic complexing component resulting in a mixture having a pH of about 3 to about 7; and further comprising adjusting the pH of about 3about 7 after the inorganic complexing component is introduced to a pH of about 6 to about 7; and heating to resulting mixture above about the Tg of the latex resin at a pH of about 6 to about 7.

7. The process of claim 1, wherein the sequestering or complexing component comprises an inorganic complexing component selected from the group consisting of sodium silicate, potassium silicate, magnesium sulfate silicate, sodium hexameta phosphate, sodium polyphosphate, sodium tripolyphosphate, sodium trimeta phosphate, sodium pyrophosphate, bentonite, and talc.

8. The process of claim 1, wherein the sequestering or complexing component is sodium silicate.

9. The process of claim 1, wherein the latex emulsion resin and the optional second latex resin are selected from the group consisting of styrene acrylates, styrene methacrylates, butadienes, isoprene, acrylonitrile, acrylic acid, methacrylic acid, beta-carboxy ethyl acrylate, polyesters, poly(styrene-butadiene), poly(methyl styrene-butadiene), poly(methyl methacrylate-butadiene), poly(ethyl methacrylate-butadiene), poly(propyl methacrylate-butadiene), poly(butyl methacrylate-butadiene), poly(methyl acrylate-butadiene), poly (ethyl acrylate-butadiene), poly(propyl acrylato-butadiene), poly(butyl acrylate-butadiene), poly(styrene-isoprene), poly (methyl styrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), poly(butyl acrylate-isoprene); poly(styrene-propyl acrylate), poly(styrene-butyl acrylate), poly(styrene-butadiene-acrylic acid), poly(styrene-butadiene-methacrylic acid), poly(styrene-butyl acrylate-acrylic acid), poly(styrene-butyl acrylate-methacrylic acid), poly(styrene-butyl acrylate-acrylonitrile), poly(styrene-butyl acrylate-acrylonitrile-acrylic acid), styrene/butyl acrylate/carboxylic acid terpolymers, styrene/butyl acrylate/beta-carboxy ethyl acrylate terpolymers and mixtures thereof; and wherein the latex emulsion resin and the optional second latex resin selected comprise the same resin or comprise different resins.

10. The process of claim 1, wherein the latex emulsion resin and the optional second latex resin comprises styrene: butylacrylate:beta-carboxyethyl acrylate.

11. The process of claim 1, wherein the latex emulsion resin and the second latex resin, when present, comprise about 70° to about 90° styrene, about 10° to about 30° butylacrylate, and about 0.5 parts per hundred to about 10 parts per hundred beta-carboxy ethyl acrylate, by weight based upon the total weight of the latex emulsion resin.

12. The process of claim 1, wherein the latex emulsion resin comprises about 76.5° styrene, about 23.5° butyl acrylate, and about 3 parts per hundred beta-carboxyethyl acrylate, by weight based upon the total weight of the latex emulsion resin; and wherein the second latex resin, when present, comprises about 81.7° styrene, about 18.3° butyl acrylate, and about 3 parts per hundred beta-carboxyethyl acrylate, by weight based upon the total weight of the optional second latex emulsion resin.

13. The toner process of claim 1, wherein the wax is an alkylene wax, a paraffin, microcrystalline wax, Fischer-Tropsch wax, or mixtures thereof.

14. The toner process of claim 1, wherein the wax comprises a wax dispersion comprising a wax having a particle size of about 100 to about 500 nanometers, water, and an anionic surfactant and optionally a nonionic surfactant.

15. The toner process of claim 1, wherein the toner particle possesses a shape factor of about 120 to about 140, a circularity of about 0.930 to about 0.980, or a combination thereof.

16. The toner process of claim 1, wherein the colorant dispersion comprises a pigment dispersion comprising pigment particles having a volume average diameter of about 50 to about 500 nanometers, water, an anionic surfactant, and optionally a polymeric stabilizer.

17. The toner process of claim 1, wherein the latex emulsion resin and the second optional resin contains a carboxylic acid group selected from the group consisting of acrylic acid, methacrylic acid, itaconic acid, beta-carboxyethyl acrylate, fumaric acid, maleic acid, and cinnamic acid; and wherein a carboxylic acid is selected in an amount of about 0.1° to about 10°, by weight based upon the total weight of the resin.

18. The toner process of claim 1, wherein the metal ion coagulant is a polymetal ion coagulant, a metal ion coagulant, a polymetal halide, a metal halide, or a mixture thereof.

19. The toner process of claim 1, wherein the metal ion coagulant is selected from the group consisting of polyaluminum chloride polyaluminum sulfosilicate, sodium chlorides, calcium chlorides, aluminum chlorides, magnesium chlorides, zinc chlorides, potassium chlorides, zirconium chlorides, sodium sulfates, calcium sulfates, aluminum sulfates, magnesium sulfates, zinc sulfates, potassium sulfates, zirconium sulfates, sodium phosphates, calcium phosphates, aluminum phosphates, magnesium phosphates, zinc phosphates, potassium phosphates, zirconium phosphates, and mixtures thereof.

20. A toner process comprising:

(i) generating or providing a latex emulsion containing resin, water, and a surfactant, and generating or providing a colorant dispersion containing colorant, water, and an ionic surfactant, or nonionic surfactant;

(ii) blending the latex emulsion wit the colorant dispersion and wax;

(iii) adding to the resulting blend a coagulant comprising a polymetal ion coagulant, a metal ion coagulant, a polymetal halide coagulant, a metal halide coagulant or a mixture thereof;

(iv) aggregating by heating the resulting mixture below or about equal to the glass transition temperature (Tg) of the latex resin;

(v) optionally adding a second latex comprised of resin particles suspended in an aqueous phase resulting in a shell;

(vi) introducing a sequestering to partially remove coagulant metal from the aggregated toner in a controlled manner;

(vii) heating the resulting mixture of (vi) above about the Tg of the latex resin at a pH of about 5 to about 6;

(viii) retaining the heating until the fusion or coalescence of resin and colorant is initiated;

(ix) changing the pH of the above (viii) mixture to arrive at a pH from about 6.0 to about 7.5 to thereby accelerate the fusion or the coalescence and resulting in toner particles comprised of resin, colorant, and having a final coagulant metal concentration of about 100 to about 900 parts per million based on the total weight of the toner particle; and (x) optionally, isolating the toner;

wherein the amount of coagulant is represented by the following equation:

$$M_{Seq}=M_{IMC}-M_{RM}$$

wherein $M_{Seq}$ represents the number of moles of sequestering agent. $M_{IMC}$ represents initial moles of metal in the coagulant, and $M_{RM}$ represents the desired final coagulant metal concentration in moles.

21. The toner process of claim 20, wherein generating or providing a latex emulsion containing resin, water, and a surfactant as in (i) comprises providing an anionic surfactant in an amount of about 0.1° to about 10° by weight based upon a total weight of the reaction mixture; and wherein the anionic surfactant is selected from the group consisting of sodium dodecylsulfate, sodium dodecylbenzene sulfonate, sodium dodecylnaphthalene sulfate, dialkyl benzenealkyl, sulfates, sulfonates, adipic acid, hexa decyldiphenyloxide disulfonate, or mixtures thereof.

22. The process of claim 20, wherein the sequestering or complexing component comprises an organic complexing component selected from the group consisting of ethylenediaminetetraacetic acid, gluconal, sodium gluconate, potassium citrate, sodium citrate, nitrotriacetate salt, humic acid, and fulvic acid;

salts of ethylenediaminetetraacetic acid, gluconal, sodium gluconate, potassium citrate, sodium citrate, nitrotriacetate salt, humic acid, and fulvic acid, alkali metal salts of ethylenediaminetetraacetic acid, gluconal, sodium gluconate, potassium citrate, sodium citrate, nitrotriacetate salt, humic acid, and fulvic acid;

sodium salts of ethylenediaminetetraacetic acid, gluconal, sodium gluconate, potassium citrate, sodium citrate, nitrotriacetate salt humic acid, and fulvic acid;

potassium salts of ethylenediaminetetraacetic acid, gluconal, sodium gluconate, potassium citrate, sodium citrate, nitrotriacetate salt, humic acid, and fulvic acid;

calcium salts of ethylenediaminetetraacetic acid, gluconal, sodium gluconate, potassium citrate, sodium citrate, nitrotriacetate salt, humic acid, fulvic acid, calcium salts of ethylenediaminetetraacetic acid, gluconal, sodium gluconate, potassium citrate, sodium citrate, nitrotriacetate salt, humic acid, fulvic acid, calcium disodium ethylenediaminetetraacetate dehydrate, diammonium-ethylenediaminetetraacetic acid, pentasodium diethylenetriaminepentaacetic acid sodium salt, trisodium N-(hydroxyethyl)-ethylenediaminetriacetate, polyasparic acid, diethylenetriamine pentaacetate, 3-hydroxy-4-pyridinone, dopamine, eucalyptus, iminodisuccinic acid, ethylenediaminedisuccinate, polysaccharide, sodium ethylenedinitrilotetraacetate, nitrilo triacetic acid sodium salt, thiamine pyrophosphate, farnesyl pyrophosphate, 2-aminoethylpyrophosphate, hydroxyl ethylidene-1,1-diphosphonic acid, aminotrimethylene-phosphonic acid, diethylene triaminepentamethylene phosphonic acid, Ethylenediamine tetramethylene phosphonic acid, and mixtures thereof.

23. The process of claim 20, wherein the sequestering or complexing component comprises an inorganic complexing component selected from the group consisting of sodium silicate, potassium silicate, magnesium sulfate silicate, sodium hexameta phosphate, sodium polyphosphate, sodium tripolyphosphate, sodium trimeta phosphate, sodium pyrophosphate, bentonite, and talc.

24. A process for preparing a developer comprising:

mixing the toner of claim 1 and a carrier.

25. An imaging process comprising:

preparing an image with a xerographic device comprising a charging component, an imaging component, a photoconductive component a developing component a transfer component, and a fusing component;

and wherein the development component comprises a developer prepared by mixing a carrier with a toner composition prepared with the process of claim 1.

26. Art imaging process comprising:

preparing an image with a xerographic device comprising a charging component, an imaging component, a photoconductive component, a developing component, a transfer component, and a fusing component;

wherein the development component comprises a developer prepared by mixing a carrier with a toner composition prepared with the process of claim 1; and wherein the xerographic device comprises a high speed printer, a black and white high speed printer, a color printer, or combinations thereof.

* * * * *